US005116549A

United States Patent [19]

Farago

[11] Patent Number: 5,116,549

[45] Date of Patent: May 26, 1992

[54] SOLUTION FLOW SPLITTING FOR IMPROVED SHEET UNIFORMITY

[75] Inventor: John Farago, Richmond, Va.

[73] Assignee: E. I. Du Pont de Nemours and Company, Wilmington, Del.

[21] Appl. No.: 636,851

[22] Filed: Jan. 2, 1991

[51] Int. Cl.[5] ..... D01D 5/11

[52] U.S. Cl. ..... 264/5; 264/13; 264/205

[58] Field of Search ..... 264/205, 13, 5

[56] References Cited

U.S. PATENT DOCUMENTS

| | | | |
|---|---|---|---|
| 3,081,519 | 3/1963 | Blades et al. | 28/81 |
| 3,169,899 | 2/1965 | Steuber | 161/72 |
| 3,227,794 | 1/1966 | Anderson et al. | 264/205 |
| 3,402,227 | 9/1968 | Knee | 264/24 |
| 3,484,899 | 12/1969 | Smith | 18/8 |
| 3,497,918 | 3/1970 | Pollock et al. | 18/2.6 |
| 3,655,498 | 4/1972 | Woodell | 264/205 |
| 3,860,369 | 1/1975 | Brethauer et al. | 425/3 |
| 4,148,595 | 4/1979 | Bednarz | 425/75 |
| 4,352,650 | 10/1982 | Marshall | 425/174.8 |
| 4,537,733 | 8/1985 | Farago | 264/9 |

*Primary Examiner*—Hubert C. Lorin

[57] ABSTRACT

A method for splitting the flow of a spin solution in a standard flash spinning process to increase sheet uniformity at increased flow rates. In one embodiment, the apparatus comprises a coarse mesh screen that is positioned within the pressure let-down zone of the spinneret assembly. The screen divides the solution flow into numerous individual sheet uniformity compared to sheets formed without the screen and at the same flow rate. The method produces nonwoven sheets having less ropiness and improved uniformity at relatively high solution flow rates.

3 Claims, 3 Drawing Sheets

SOLUTION FLOW SPLITTING FOR IMPROVED SHEET UNIFORMITY

FIELD OF THE INVENTION

The present invention relates to splitting the flow of a spin solution through a spinneret assembly to increase web uniformity at increased flow rates. In particular, the invention relates to an improved apparatus and method for making spunbonded polyolefin sheets wherein the solution flow is split into a plurality of individual streams such that the resulting flashspun plexifilamentary film-fibrils are laid down side by side into a uniform sheet.

BACKGROUND OF THE INVENTION

Many processes are known wherein fibers from a plurality of positions are deposited and intermingled on the surface of a moving collection surface to form a wide nonwoven sheet. For instance, U.S. Pat. No. 3,402,227 (Knee) discloses a plurality of single orifice jets positioned above a receiver and spaced in a line that makes an angle with the direction of receiver movement so that the fiber streams that issue from the jets deposit fibers on discrete areas of the receiver to form ribbons which combine with ribbons formed from other streams along the line.

Several methods are known for directing the fibers from a plurality of positions to various locations across the width of the collection surface. For example, U.S. Pat. No. 3,169,899 (Steuber) discloses the use of curved oscillating baffles for spreading flashspun plexifilamentary strands while oscillating and directing them to a moving collection surface. Processes for flash-spinning plexifilamentary strands from a polymer spin solution are disclosed in U.S. Pat. Nos. 3,081,519 (Blades et al.) and 3,227,794 (Anderson et al.).

An efficient and improved method for depositing fibers onto the surface of a moving collection surface is disclosed in U.S. Pat. No. 3,497,918 (Pollock et al.). In a preferred embodiment of Pollock et al., plexifilamentary strands are flashspun and forwarded in a generally horizontal direction into contact with the surface of a rotating-lobed baffle. The baffle deflects the strand and accompanying expanded solvent gas downward into a generally vertical plane. Simultaneously, the baffle spreads the strands into a wide, thin web and causes the web to oscillate as it descends toward the collection surface. An electrostatic charge is imparted to the web during its descent to the collection surface. The web is then deposited as a wide swath on the surface of the collection surface. To make a wide sheet, numerous flash-spinning units of this type are employed. The units are positioned above the moving collection surface so that the deposited swaths form ribbons which partially overlap and combine to form a multi-layered sheet.

U.S. Pat. No. 4,537,733 (Farago) suggests that a multi-position apparatus of the type described in Pollock et al. be operated with the frequency of oscillation of the fiber streams varying by more than ±5%, but less than ±50% of the average oscillation frequency, in order to eliminate gage bands in the resulting nonwoven sheet. Gage bands do not necessarily produce a visual defect in the flat sheet itself, but are usually noticeable when a large roll is formed from the nonwoven sheet. The method of Farago and the apparatus of Pollock et al. have been modestly successful in reducing gage bands in the commercial production of wide nonwoven sheets prepared from flash-spun plexifilamentary strands. Such sheets are commercially available from E. I. du Pont de Nemours and Company under the trademark Tyvek® spunbonded polyolefin.

However, the utility of the nonwoven sheets could further be enhanced by improvements in sheet uniformity and appearance, particularly with regard to reducing the frequency and size of an undesired effect, referred to herein as "ropiness". Ropiness exhibits itself as agglomerated groups of fibers or fibrils that look like strings on the surface or within an otherwise uniform sheet. Ropes occur when a web becomes twisted or collapses on itself. Ropiness is especially apparent when viewed with a light source provided behind the sheet. Such nonuniformities often measure as much as 30 cm long and 1 cm wide and detract from the utility of the sheet, especially in end-uses that require printing on the sheet. The problems of ropiness and overall sheet quality become worse when the flow rate of the spin solution from individual spin positions is increased. This occurs since handling becomes inherently more difficult with larger and coarser webs. As flow rates are increased, the gas streams conveying the swaths interact more turbulently with each other and cause the uniformity of the resulting sheet to decrease.

Clearly, what is needed is an apparatus and method for economically maintaining or improving the uniformity of a nonwoven sheet as the flow rate of the spin solution from individual spin positions is increased. It is therefore an object of the present invention to provide an apparatus and method for making nonwoven sheets having less ropiness and improved uniformity at relatively high individual spin position flow rates. Other objects and advantages of the present invention will become apparent to those skilled in the art upon reference to the attached drawings and to the detailed description of the invention which hereinafter follows.

SUMMARY OF THE INVENTION

In accordance with the invention, there is provided an apparatus and method for splitting the solution flow of a spin mixture used in a standard flash spinning process for making nonwoven sheets. In one aspect, the invention comprises an improvement in a flash-extrusion apparatus of the type for flash-spinning a polymer solution, which apparatus includes a spinneret assembly having a spinning orifice and a let-down chamber for lowering the pressure of the solution upon flow therethrough prior to discharge through the spinning orifice. The improvement comprises a coarse mesh screen positioned within the let-down chamber to split the flow of the solution into a plurality of individual streams prior to discharge through the spinning orifice. Preferably, the apparatus comprises a 4–20 mesh screen that is positioned within the pressure let-down chamber of the general type disclosed in FIG. 2 of U.S. Pat. No. 3,227,794 (Anderson et al.). In this preferred embodiment, each opening in the screen produces an individual web. Since the webs are smaller in total area, they have less tendency to form ropes. The resulting flash-spun plexifilamentary film-fibrils are laid down side by side into a uniform sheet, even as the solution flow rate from individual spin positions is increased. Preferably, the solution flow rate is between 85 to 200 lb/hr.

In yet another aspect, the invention comprises an improved process for the flash spinning of fibrillated plexifilamentary material by the steps of continuously supplying, under pressure into a dissolution zone, a solution of synthetic crystallizable, organic polymer of filament-forming molecular weight and a solvent for the polymer, the concentration of polymer being 2 to 20% by weight of the solution, dissolving the polymer and forming a polymer solution having a temperature of at least the solvent critical temperature minus 45° C. and a pressure above the two-liquid-phase boundary for the solution, forwarding the solution through a transfer zone, passing the solution into a pressure let-down zone for lowering the pressure of the solution to below the two-liquid-phase pressure boundary for the solution, and discharging the solution through a spinneret orifice of restricted size to an area of substantially atmospheric pressure and temperature. The improvement comprises splitting the solution flow into a plurality of individual streams within the let-down zone before the solution is discharged to the area of substantially atmospheric pressure and temperature.

Due to the unique nature of the polymer spin solution used in flash-spinning operations (i.e., a two-phase dispersion), the solution will remain divided after it has passed through the screen and through the orifice. This is surprising since most liquids will not continue to flow as individual streams in a common channel after they have been divided. The two-phase dispersion will "remember the division" because of the large difference in viscosity between the continuous solution phase and the low viscosity solvent phase. Due to the viscosity difference, any obstruction or shear forces in the flow path will lead to the coalescence of the low viscosity phase forming a number of streams that do not get mixed in the downstream flow path. As a result, the divided structure is retained during the flow through the let-down chamber and through the spinneret orifice. The plexifilamentary film-fibrils produced outwardly appear to be large, as in conventional flash spinning, but actually have a fine divided structure that produces uniform webs with less tendency to form ropes or other agglomerates.

BRIEF DESCRIPTION OF THE DRAWINGS

The invention will be better understood with reference to the following figures.

DETAILED DESCRIPTION OF THE PREFERRED EMBODIMENTS

Figure 1:
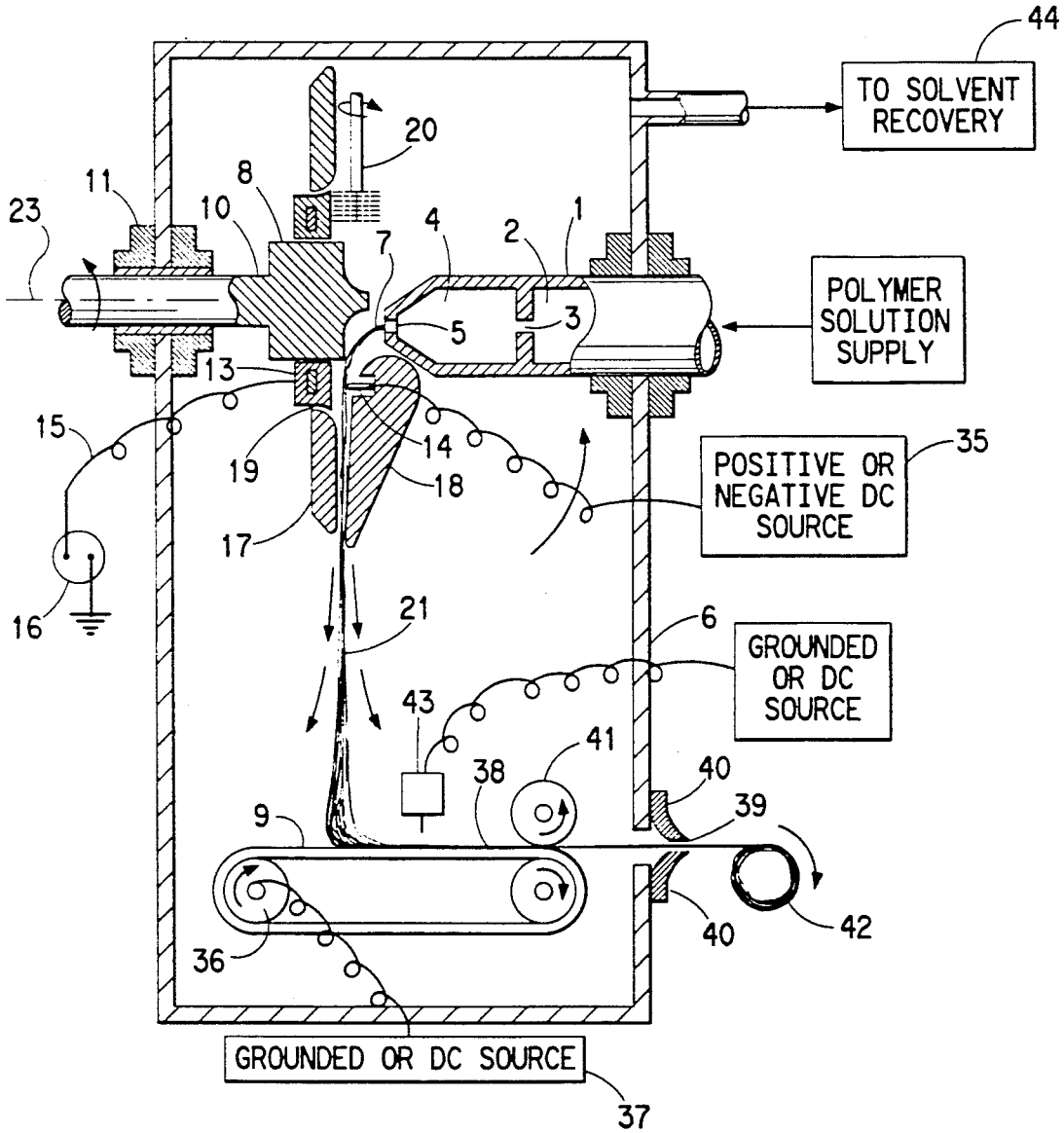
FIG. 1 is a schematic cross-sectional view of the arrangement of various elements of an apparatus that can be used with the present invention and is similar to FIG. 1 of U.S. Pat. No. 4,148,595 (Bednarz).

Referring now to the figures, wherein like reference numerals represent like elements, FIG. 1 shows a general flash-extrusion apparatus similar to that disclosed in U.S. Pat. No. 4,148,595 (Bednarz). As shown in Bednarz and in FIG. 1 herein, the apparatus generally includes a spinneret assembly 1, positioned opposite a rotable baffle 8, an aerodynamic shield comprised of members 13, 17 and 18 located below the baffle and including corona discharge needles 14 and target plate 13, and a collection surface 9 below the aerodynamic shield. A more detailed description is found in Bednarz at column 1, line 67 through column 2, line 34 and in U.S. Pat. No. 3,860,369 (Brethauer et al.) at column 3, line 41 through column 4, line 63, the contents of which are incorporated herein.

Figure 2:
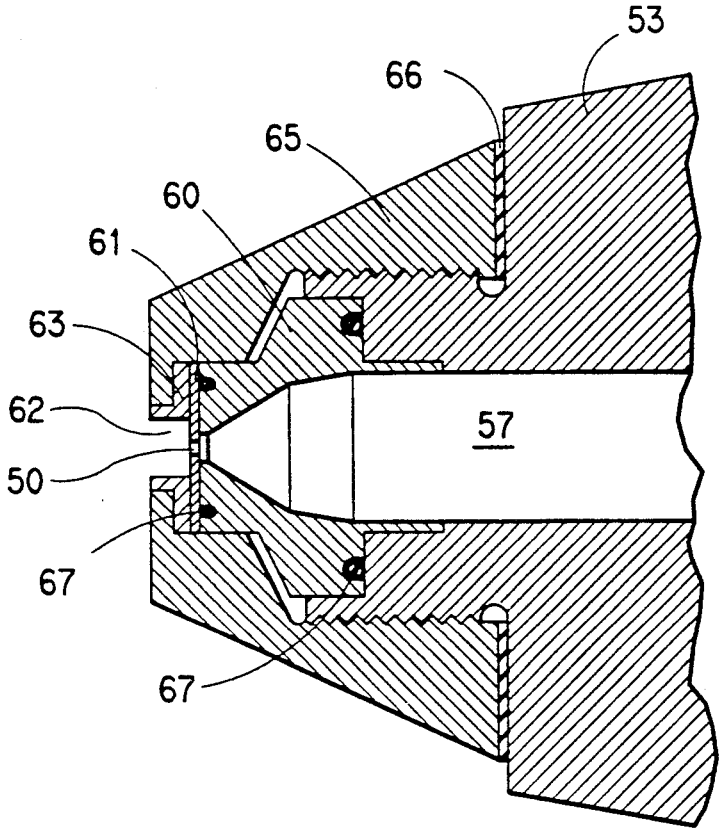
FIG. 2 is a cross-sectional view of a nozzle attached to the exit portion of a flash-extrusion spinneret assembly similar to that disclosed in FIG. 5 of U.S. Pat. No. 3,484,899 (Smith).

FIG. 2 is an enlarged cross-sectional view of a portion of the horizontal spinneret assembly similar to that depicted in FIG. 5 of U.S. Pat. No. 3,484,899 (Smith) and described in column 4, lines 57 through 75 of that patent, but differing primarily by the inclusion of an exit insert 63 which has a flared tunnel 62 located therein. The flared tunnel 62 is the subject of U.S. Pat. No. 4,352,650 (Marshall), the contents of which are incorporated herein. A converging pressure let-down chamber 57 is located in the spinneret body 53 of the horizontal spinneret assembly. If one follows from right to left in FIG. 2, thereby following the direction of extrusion in the apparatus, one finds let-down chamber 57 leading through orifice-approach insert 60 to disc 61 which contains orifice 50, then to exit insert 63 containing flared tunnel 62. Inserts 60 and 63 are fastened to spinneret body 53 by means of threads in tapered nose piece 65. Gasket 66 and O-ring 67 prevent leakage.

Figure 3:
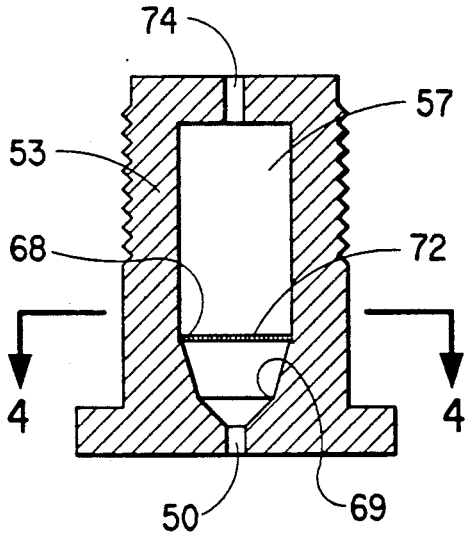
FIG. 3 is a cross-sectional view of a spinneret assembly having a pressure let-down chamber containing a coarse mesh screen in accordance with the invention.

FIG. 3 shows a simplified view of the spinneret body 53 and the converging let-down chamber 57 of FIG. 2. In this figure, a coarse mesh screen 72, preferably 4–20 mesh, is positioned within the pressure let-down chamber 57, before the spin solution is discharged through the orifice 50. The spin solution enters the spinneret body 53 through constriction 74 and passes to the pressure let-down chamber 57. The flow is split by screen 72 into numerous individual streams. The number of streams produced is directly dependent on the number of openings in the screen. Screen 72 is positioned so that it extends across the entire inner diameter of let-down chamber 57 and so that it is supported on the annular shelf created at the junction point 68 where the let-down chamber 57 begins to converge towards orifice 50. In this manner, all of the spin solution passes through screen 72. It will be understood that the screen may also be supported within the let-down chamber 57 by other securing means (e.g., slots or grooves within the chamber wall). The let-down chamber 57 converges more sharply towards orifice 50 at junction point 69.

As noted above, the invention lies in the recognition that the two-phase dispersion will remain divided after the shear forces created by the screen have been applied. The divided streams flow side by side as separate streams through the remainder of the let-down chamber and through the orifice 50. The polymer is, in effect, surrounded by the solvent as it travels from the screen 72 towards the orifice 50. As noted before, this is caused by the so-called "memory of the dispersion" where the polymer and solvent remain disperse in laminar flow profiles. As the individual streams are extruded through the orifice 50, the "split personality" of the streams continues so that the plexifilamentary strands that are formed lay down side-by-side on the collection surface 9 in a very uniform manner. It is to be noted that no such division will occur with any other type of spinning solution (i.e, when a two-phase dispersion is not present).

Figure 4:
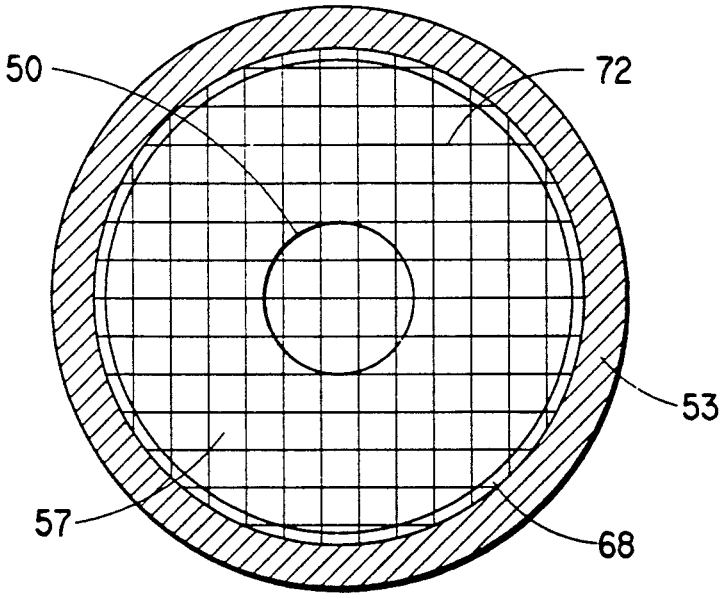
FIG. 4 is a cross-sectional view of the let-down chamber of FIG. 3 showing the coarse mesh screen in greater detail within the let-down zone.

FIG. 4 is a cross-sectional view of FIG. 3 showing screen 72 in greater detail within the let-down chamber 57 of spinneret body 53. Screen 72 is supported at junction point 68 within let-down chamber 57. Each opening in screen 72 produces an individual spin solution stream that is extruded downstream through orifice 50.

EXAMPLES

The invention will be further described by reference to the following non-limiting examples. In these examples, swath analysis for ropes and split webs is determined by the following procedure:

(1) A one yard sample of a sheet is laid out on a large inspection table. The top side and bottom side of the sheet are noted. Weights are placed on the sheet to secure the sheet while swath analysis is performed;

(2) On the top side of the sheet, an individual swath is carefully pulled away from the sheet. The swath's appearance is observed and the following characteristics are noted and recorded:

(a) the number of small, medium or large ropes that have collapsed or become twisted yarn bundles;

(b) the number of split webs (i.e., openings in the web larger than 1 inch). It is noted if these are large (i.e. more than 6 inches in length);

(c) the number of folds which are large collapsed but not twisted web structures; and (d) the number of stringy webs having broken web filaments that are not part of the continuous web;

(3) Another individual swath is carefully pulled away from the others and observed as noted above. This is continued for successive swaths across the sheet until the opposite edge of the sheet is reached. The rest of the sheet is cut off as edge trim; and (4) The sheet is turned over on the inspection table so that the bottom is exposed. The same analysis as set forth in steps 2 and 3 above is performed on the bottom of the sheet.

EXAMPLE 1

The inventive apparatus of FIG. 3 (i.e., a coarse mesh screen) was used in the standard process of U.S. Pat. No. 4,352,650 (Marshall) to produce a nonwoven sheet having a basis weight of 2.0 oz/yd$^2$. The solvent used was trichlorofluoromethane and the polymer was polyethylene. The flow rate of the spin solution was maintained at about 150 lb/hr. In this example, a 12 mesh screen fabricated from 314 stainless steel was positioned in the pressure let-down chamber of the standard apparatus and process of U.S. Pat. No. 3,227,794 (Anderson et al.). A swath analysis was performed to indicate the number of ropes within the resulting nonwoven sheet. AS a comparison, a 2.0 oz/yd$^2$ nonwoven sheet was also produced using the standard process of Anderson et al., except without the aid of the applicant's inventive screen. Swath widths were about the same for both sheets. The comparison sheet is characterized as the "Prior Art Sheet". The results are summarized in Table I as follows:

TABLE I

| Type of Rope | Inventive Sheet | Prior Art Sheet |
|---|---|---|
| None or small | 48 | 40 |
| Medium | 0 | 11 |
| Heavy | 0 | 0 |
| Folds | 0 | 16 |

EXAMPLE 2

Example 1 was repeated except that a 3.3 oz/yd$^2$ nonwoven sheet was made with and without the benefit of the applicant's inventive screen. The results are summarized in Table II and generally indicate that ropes and folds are not as prevalent in higher basis weight sheets.

TABLE II

| Type of Rope | Inventive Sheet | Prior Art Sheet |
|---|---|---|
| None or small | 12 | 10 |
| Medium | 3 | 5 |
| Heavy | 0 | 1 |
| Folds | 0 | 2 |

The swaths made from the inventive apparatus appeared to be finer and freer from defects than the swaths made from the prior art comparisons, but there was a slight tendency for more split webs to be produced. However, the split webs appeared to be of good quality, the split was only intermittent and the increase did not affect sheet uniformity. The sheets made by the inventive apparatus and method had an overall quality heretofore only attainable when the spin solution was run at flow rates about one half of the flow rate used in the Examples (e.g., 85 lbs/hr). The number of split webs are summarized in Table III for the swaths made in Examples 1 and 2.

TABLE III

| | Split Webs | | | |
|---|---|---|---|---|
| | w/screen (2.0 oz/yd$^2$) | w/o screen (2.0 oz/yd$^2$) | w/screen (3.3 oz/yd$^2$) | w/o screen (3.3 oz/yd$^2$) |
| Small | 20 | 36 | 8 | 8 |
| Medium | 24 | 10 | 4 | 4 |
| Large | 2 | 6 | 3 | 3 |
| Extra Large | 2 | 0 | 0 | 0 |

An added benefit of the invention is that there is an increase in spinneret assembly life when using the applicant's inventive screen. It has been discovered that the average inventive test assembly life was about 5 days versus the standard commercial assembly life of about 4 days.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

I claim:

1. An improved process for the flash spinning of fibrillated plexifilamentary material by the steps of continuously supplying under pressure into a dissolution zone, a synthetic crystallizable, organic polymer of filament-forming molecular weight and a solvent for the polymer, the concentration of polymer being 2 to 20% by weight of the solution, dissolving the polymer and forming a polymer solution having a temperature of at least the solvent critical temperature minus 45° C. and a pressure above the two-liquid-phase boundary for the solution, forwarding the solution through a transfer zone, passing the solution into a pressure let-down zone for lowering the pressure of the solution to below the two-liquid-phase pressure boundary for the solution, and discharging the solution through a spinneret orifice of restricted size to an area of substantially atmospheric pressure and temperature, the improvement comprising splitting the solution flow into a plurality of individual streams within the pressure let-down zone before the solution is discharged through the spinneret orifice.

2. The improved process of claim 1 wherein the polymer and solvent are continuously supplied to the dissolution zone at a rate of between 85 to 200 lbs/hr.

3. The improved process of claim 1 wherein the solvent is trichlorofluoromethane and the polymer is polyethylene.

* * * * *